US010297940B2

(12) United States Patent
Tanikawa

(10) Patent No.: US 10,297,940 B2
(45) Date of Patent: May 21, 2019

(54) TERMINAL

(71) Applicant: Sumitomo Wiring Systems, Ltd., Yokkaichi, Mie (JP)

(72) Inventor: Naotaka Tanikawa, Mie (JP)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 0 days.

(21) Appl. No.: 15/955,902

(22) Filed: Apr. 18, 2018

(65) Prior Publication Data

US 2018/0316112 A1 Nov. 1, 2018

(30) Foreign Application Priority Data

Apr. 26, 2017 (JP) ..... 2017-086841

(51) Int. Cl.

| | |
|---|---|
| ***H01R 13/11*** | (2006.01) |
| ***H01R 13/422*** | (2006.01) |
| ***H01R 13/642*** | (2006.01) |
| *H01R 43/16* | (2006.01) |

(52) U.S. Cl.

CPC ..... *H01R 13/113* (2013.01); *H01R 13/114* (2013.01); *H01R 13/4223* (2013.01); *H01R 13/642* (2013.01); *H01R 13/111* (2013.01); *H01R 43/16* (2013.01)

(58) Field of Classification Search

CPC ..... H01R 13/15; H01R 13/187; H01R 13/052
USPC ..... 439/852, 851
See application file for complete search history.

(56) References Cited

U.S. PATENT DOCUMENTS

| | | | | |
|---|---|---|---|---|
| 6,520,811 | B2 * | 2/2003 | Mitani | H01R 13/113 439/843 |
| 7,048,582 | B2 * | 5/2006 | Tabata | H01R 13/113 439/595 |
| 7,351,122 | B2 * | 4/2008 | Suemitsu | H01R 13/113 439/852 |
| 7,419,410 | B2 * | 9/2008 | Myer | H01R 13/113 439/852 |
| 7,530,859 | B2 * | 5/2009 | Moll | H01R 4/185 439/852 |
| 8,858,274 | B2 * | 10/2014 | Jakoplic | H01R 13/11 439/843 |
| 2003/0049965 | A1 | 3/2003 | Fujita et al. | |
| 2003/0049975 | A1 | 3/2003 | Tsuji et al. | |
| 2003/0228793 | A1 | 12/2003 | Ichida et al. | |

(Continued)

FOREIGN PATENT DOCUMENTS

JP 2004-31034 1/2004

*Primary Examiner* — Hien D Vu
(74) *Attorney, Agent, or Firm* — Gerald E. Hespos; Michael J. Porco; Matthew T. Hespos

(57) ABSTRACT

A terminal (10) includes a rectangular tubular box (20) that is open in a front-rear direction. The box (20) includes a bottom wall (30), first and second side walls (40,50) rising from sides (31) of the bottom wall (30), a ceiling wall (60) extending from an upper edge (41) of the first side wall (40) toward the second wall (50) and an outer wall (70) extending from an upper end(51) of the second side wall (50) toward the first side wall (40) along an upper surface of the ceiling wall (60). A holding piece (74F) projects on an extending end part (73F) of the outer wall (70). A holding recess (45F) is provided on an upper end part of the first side wall (40) and receives the holding piece (74F) so that a part of the holding piece (74F) is located inside the box (20).

4 Claims, 12 Drawing Sheets

(56) References Cited

U.S. PATENT DOCUMENTS

| | | | |
|---|---|---|---|
| 2003/0228795 | A1 | 12/2003 | Ichida et al. |
| 2003/0228796 | A1 | 12/2003 | Nankou et al. |
| 2003/0228797 | A1 | 12/2003 | Ishikawa et al. |
| 2003/0228798 | A1 | 12/2003 | Nankou et al. |
| 2005/0032424 | A1 | 2/2005 | Ichida et al. |

* cited by examiner

TERMINAL

BACKGROUND

Field of the Invention

This specification relates to a terminal.

Description of the Related Art

Japanese Unexamined Patent Publication No. 2004-31034 discloses a female terminal with a rectangular tubular box-shaped body and a barrel that is connectable to an end of a wire by crimping. The body is composed of a bottom wall, two side walls rising from both sides of the bottom wall, a ceiling wall facing the bottom wall and an outer wall overlapped on an outer side of the ceiling wall. A front holding piece is provided on a side edge of the outer wall and projects toward the bottom wall. The side wall is provided with a front holding groove into which the front holding piece is fit. In this way, the front edge of the front holding piece is locked to the front edge of the holding groove from behind. This configuration is intended to prevent the outer wall from turning up and undergoing an opening deformation, for example, if a force acts to displace the outer wall forward when the wire is pulled rearward. However, a locking margin between the front edge of the front holding piece and the front edge of the front holding groove is only a plate thickness. Thus, a locked state cannot be maintained, and the outer wall can be turned up to undergo an opening deformation, if the front holding piece is deformed toward an outer side of the body by more than the plate thickness.

SUMMARY

A terminal disclosed in this specification is a formed of a plate material and includes a rectangular tubular box that is open in a front-rear direction. The box includes a bottom wall, first and second side walls rising from opposite sides of the bottom wall, a ceiling wall extending from an upper end of the first side wall toward the second side wall and an outer wall extending from an upper edge of the second side wall toward the first side wall along an upper surface of the ceiling wall. A holding piece projects on an extending end part of the outer wall and a holding recess is provided on an upper end part of the first side wall. The holding piece is accommodated inside the holding recess, and a part of the holding piece is located inside the box.

According to this configuration, even if the holding piece is displaced laterally by a plate thickness, the holding piece remains located inside the holding recess. Thus, a locked state of the holding piece and the holding recess can be maintained.

A base end part of the holding piece may be bent inwardly of the box portion so that a projecting end part of the holding piece is located inside the box portion, a restricted portion may be provided to project rearward on a rear edge of the holding piece and a restricting portion may be provided by recessing a rear edge of the holding recess rearwardly, the restricted portion being lockable to the restricting portion from below.

A force that acts on the outer wall from behind will tend to cause the outer wall to turn up along a bending line perpendicular to the force. Thus, the holding piece is urged up and also will be urged forward together with the outer wall. However, the restricted portion is locked to the restricting portion from below in the subject invention. Therefore, the holding piece cannot displace up and the outer wall cannot turn up.

A force that acts on the outer wall from behind also could cause the outer wall to turn up along a bending line that is oblique to the force. In this situation, the holding piece is urged laterally and also is urged forward with the outer wall. However, even if the holding piece of the connector of the invention is displaced laterally by the plate thickness, the restricted portion remains at a position locked to the restricting portion from below. Thus, the holding piece cannot displace up and the outer wall cannot turn up.

A projecting end of the holding piece may have a lower surface, an inner surface inward of the lower end surface and an outer surface disposed outward of the lower surface. A corner between the lower surface and the inner surface may be located inside the box beyond the holding recess, and the outer side surface may be located in the holding recess.

A part of the holding piece is inside the box, but a projecting dimension of the projecting part of the holding piece in the box must avoid interference with a mating terminal that is to be fit into the box. Accordingly, the outer surface of the holding piece is located inside the holding recess according to the above configuration. Thus, the projecting dimension of the projecting end of the holding piece into the box is suppressed to a minimum level. Further, the corner between the lower surface and the inner surface of the holding piece is located inside the box beyond the holding recess, even if the holding piece is displaced laterally by the plate thickness. Thus, the projecting end of the holding piece can remain inside the holding recess.

The holding recess may have a facing surface facing the lower surface of the holding piece, and a distance from a corner between the facing surface and an outer side surface of the one side wall to a corner of the holding piece may be equal to or longer than a plate thickness of the holding piece. Thus, even if the holding piece is displaced laterally by the plate thickness, the corner of the holding piece remains inside the holding recess.

A projection may be provided on an inner side surface of the holding piece and may project inwardly of the box at least by the plate thickness for locking to the ceiling wall from below. This locking of the projection to the ceiling wall from below prevents the outer wall from turning-up.

According to the terminal disclosed in this specification, even if the holding piece is displaced laterally by the plate thickness, the locked state of the holding piece and the holding recess can be maintained and the outer wall will not turn-up.

DETAILED DESCRIPTION

Figure 1:
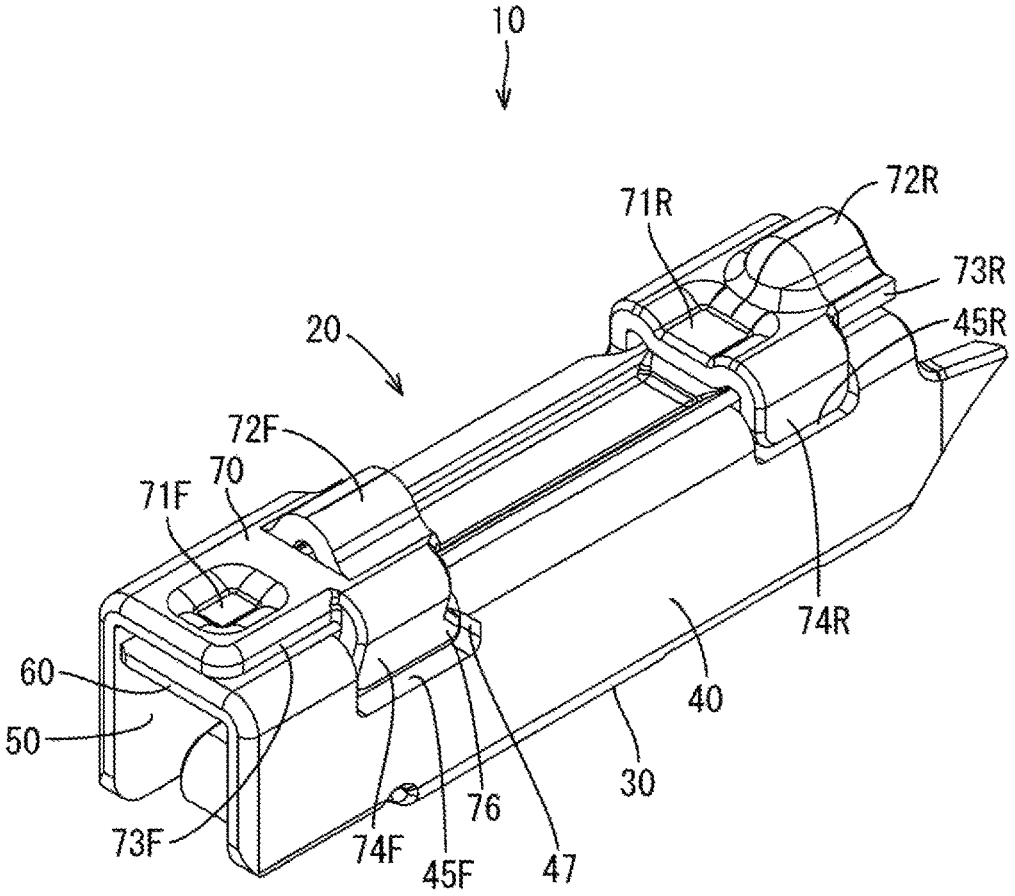
FIG. 1 is a left front perspective view of a terminal of a first embodiment.
Figure 2:
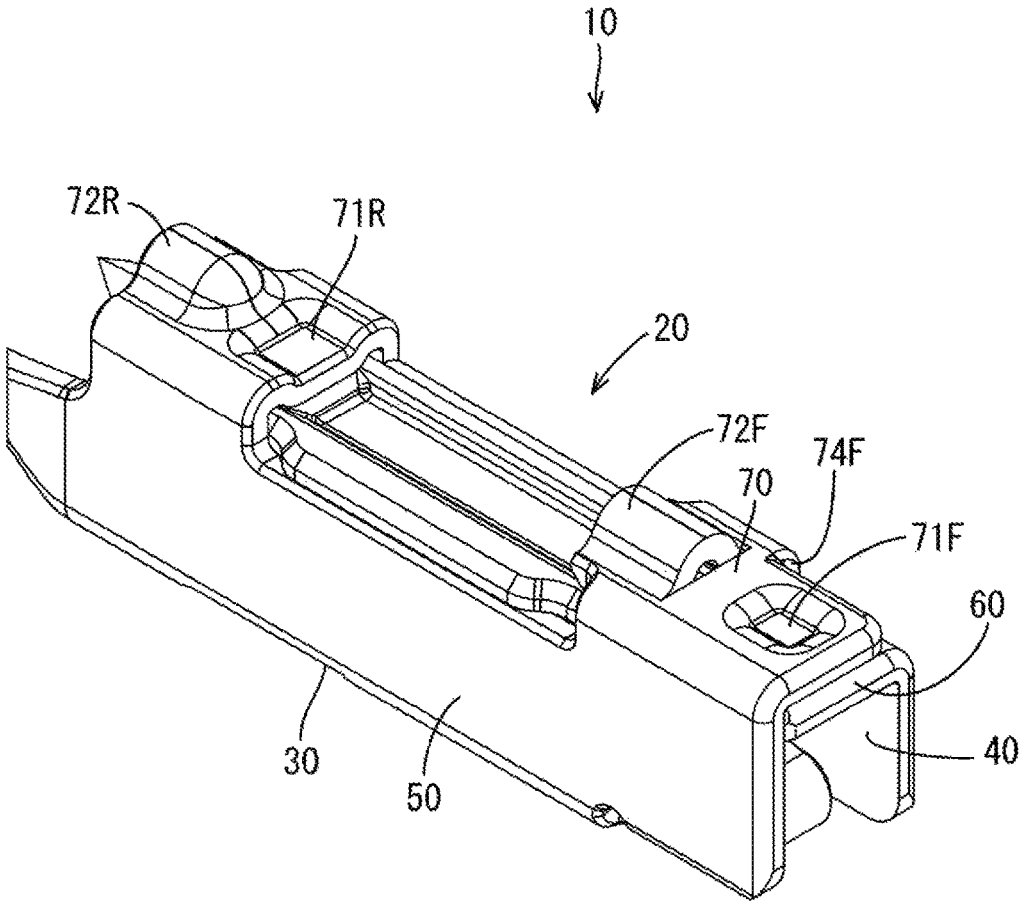
FIG. 2 is a right front perspective view of the terminal.

A first embodiment is described with reference to FIGS. 1 to 9. A terminal 10 in the first embodiment is a female terminal and includes, as shown in FIGS. 1 and 2, a box 20 and a wire connecting portion 80 (see FIGS. 3 and 4) connected to and behind the box 20. The box 20 is a rectangular tube that is open in a front-rear direction and is configured to be connected to an unillustrated male terminal. The wire connecting portion 80 includes a wire barrel 81 to be crimped to a core of an unillustrated wire and an insulation barrel 82 to be crimped to an insulation coating. The terminal 10 is formed of a plate material made of metal with good conductivity.

Figure 3:
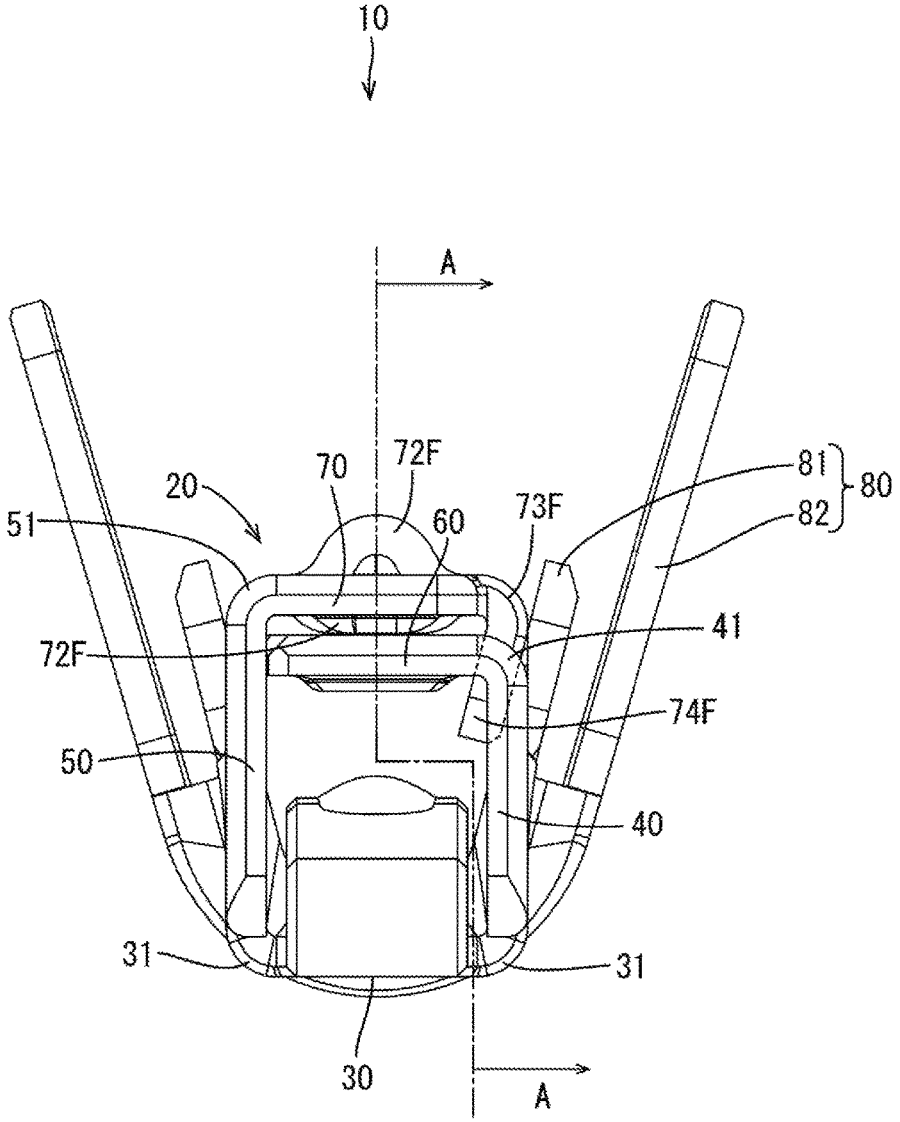
FIG. 3 is a front view of the terminal.

As shown in FIG. 3, the box 20 includes a bottom wall 30, first and second side walls 40, 50 rising from first and second sides 31 of the bottom wall 30, a ceiling wall 60 laterally extending from an upper end 41 of the first side wall 40 toward the second side wall 50 and outer walls 70 extend laterally from an upper end 51 of the second side wall 50 toward the first side wall 40. As shown in FIG. 1, the outer walls 70 are separated on front and rear parts of the box 20. The front outer wall 70 is struck down to form a front butting portion 71F that is in contact with the upper surface of the ceiling wall 60. The front outer wall 70 is disposed along the upper surface of the ceiling wall 60 with a clearance equivalent to a projecting dimension of the front butting portion 71F defined between the front outer wall 70 and the upper surface of the ceiling wall 60. The rear outer wall 70 has a rear butting portion 71R similar to the front butting portion 71F.

A locking protrusion 72F is provided at the front outer wall 70 behind the front butting portion 71F and is lockable from behind by a locking lance 90 (see FIG. 9) in an unillustrated housing. The locking protrusion 72F is formed by striking a part of the outer wall 70 up. The locking lance 90 is locked to the locking protrusion 72F when the terminal 10 is inserted into the housing from behind, thereby holding the terminal 10 in the housing. The rear outer wall 70 also has a locking protrusion 72R similar to the locking protrusion 72F. However, the front locking protrusion 72F is formed by striking after providing a slit in advance.

A front holding piece 74F projects down on an extending end part 73F of the front outer wall 70, and a rear holding piece 74R projects down on an extending end part 73R of the rear outer wall 70. The rear holding piece 74R is parallel to the first side wall 40, whereas a base end part of the front holding piece 74F is bent in so that a projecting end part faces inward of the box 20.

Front and rear holding recesses 45F and 45R are provided separately in the front-rear direction on an upper end part of the first side wall 40 and receive the front and rear holding pieces 74F and 74R respectively.

Figure 4:
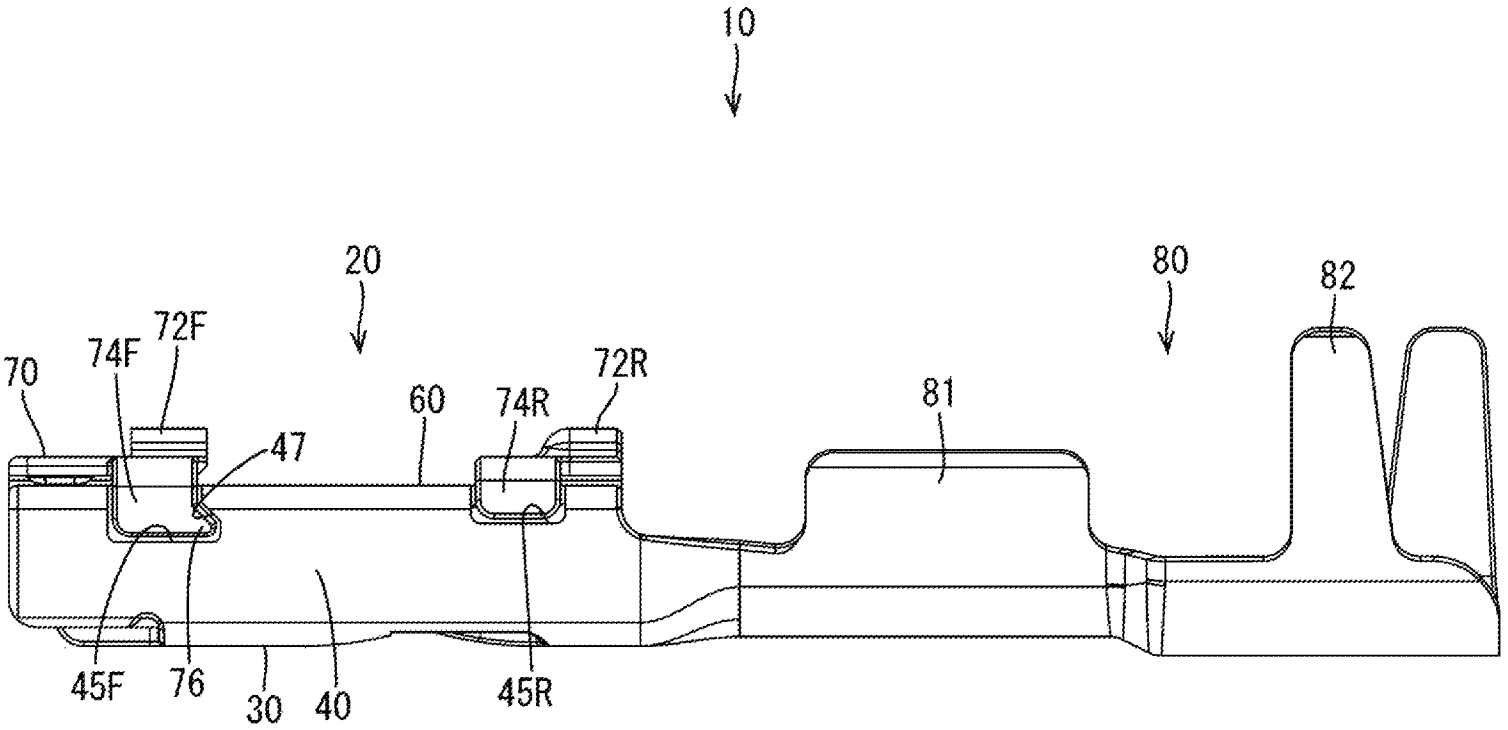
FIG. 4 is a side view of the terminal.
Figure 5:
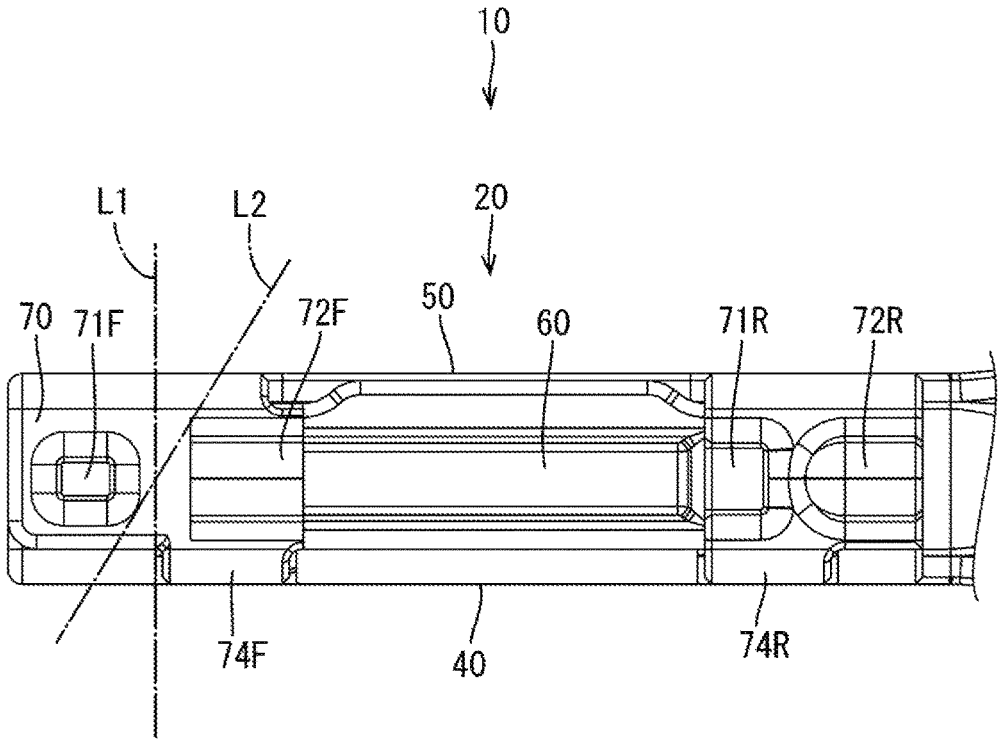
FIG. 5 is a top plan view of the terminal.
Figure 6:
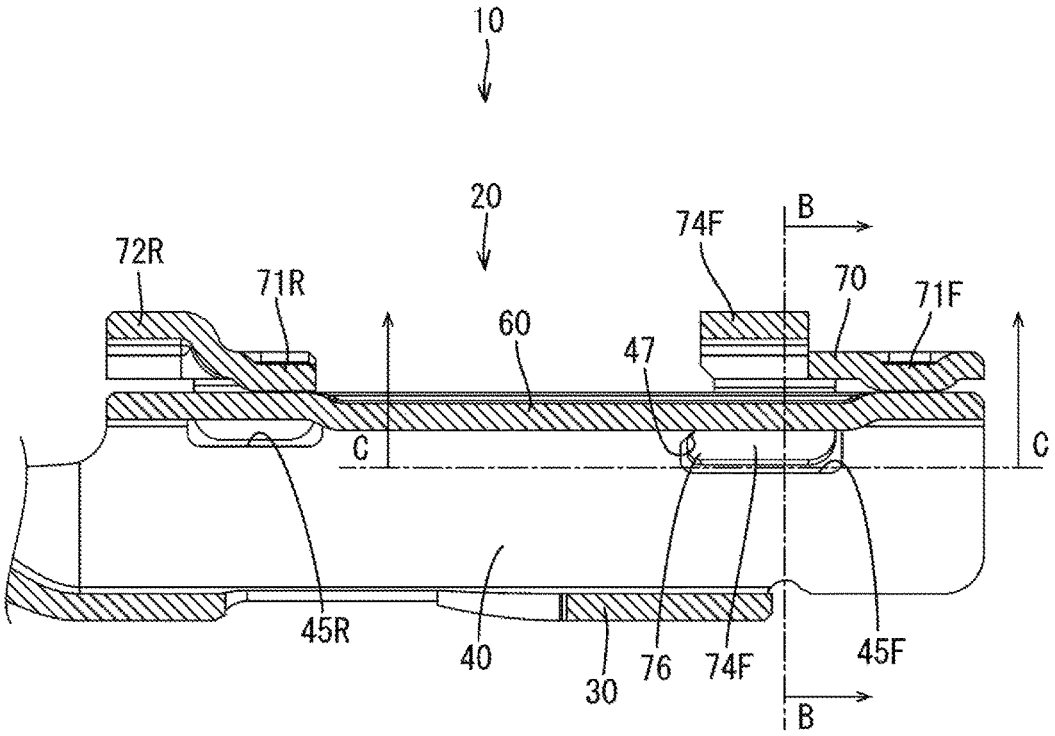
FIG. 6 is a section taken along line A-A in FIG. 3.

As shown in FIG. 4, a restricted portion 76 projects rearward on a lower end part of the rear edge of the front holding piece 74F. On the other hand, the rear edge of the front holding recess 45F is recessed rearward to provide a restricting portion 47 to which the restricted portion 76 is lockable from below. The restricted portion is accommodated inside the restricting portion 47.

Figure 7:
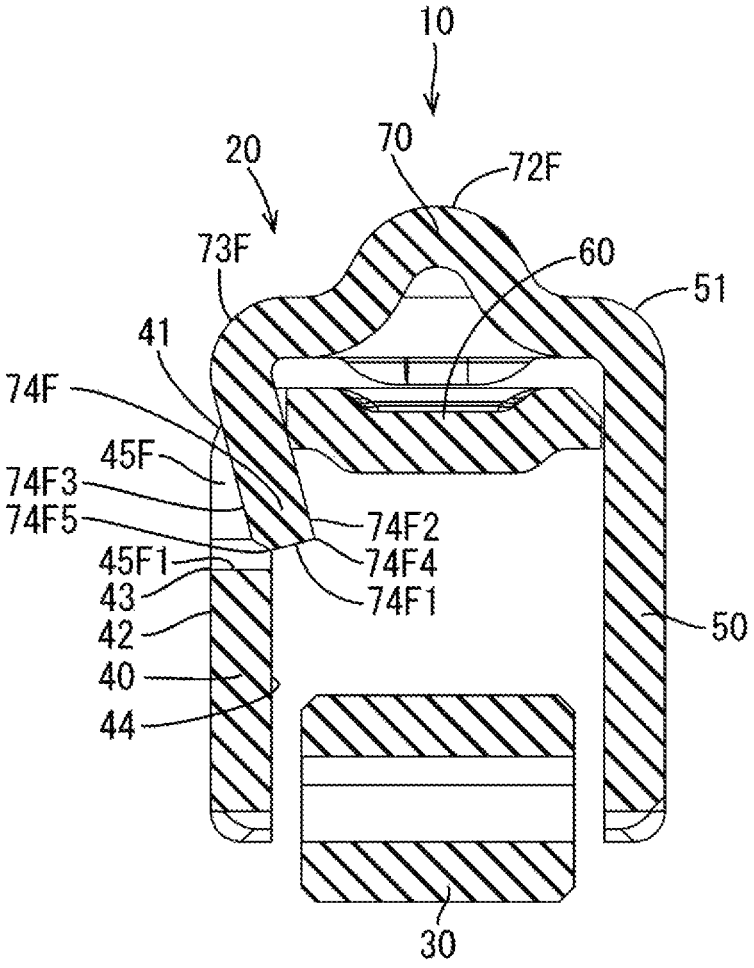
FIG. 7 is a section taken along line B-B of FIG. 6.
Figure 8:
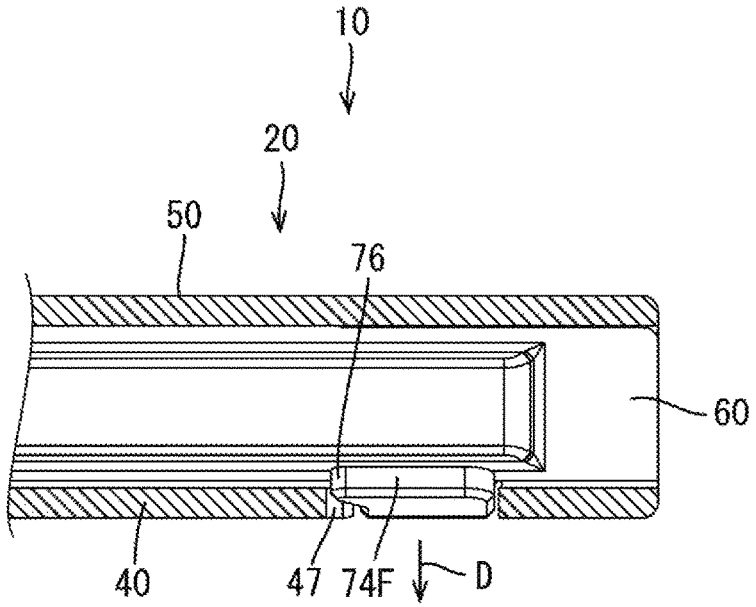
FIG. 8 is a section taken along line C-C of FIG. 6.

As shown in FIG. 7, a part of the front holding piece 74F is located inside the box 20. More specifically, the projecting end part of the front holding piece 74F has a lower surface 74F1, an inner surface 74F2 inward of the lower surface 74F1 and an outer surface 74F3 outward of the lower end surface 74F1. A corner 74F4 between the lower surface 74F1 and the inner surface 74F2 is located inside the box 20 beyond the front holding recess 45F, and the outer side surface 74F3 is located inside the front holding recess 45F. The corner 74F4 of the front holding piece 74F is disposed so that a projecting height from an inner side surface 44 of the first side wall 40 is within a plate thickness of the front holding piece 74F. More specifically, the lower end surface 74F1 of the front holding piece 74F has a chevron shape projecting down, and a lower end 74F5 thereof is at a position aligned with the inner surface 44 of the first side wall 40 in a vertical direction.

The front holding recess 45F has a facing surface 45F1 facing a tapered surface 74F5 of the front holding piece 74F, and a distance from a corner 43 between the facing surface 45F1 and an outer side surface 42 of the first side wall 40 to the corner 74F4 of the front holding piece 74F is equal to or longer than the plate thickness of the front holding piece 74F. Thus, even if the front holding piece 74F is displaced laterally by the plate thickness, the corner 74F4 of the front holding piece 74F is located inside the front holding recess 45F.

Figure 9:
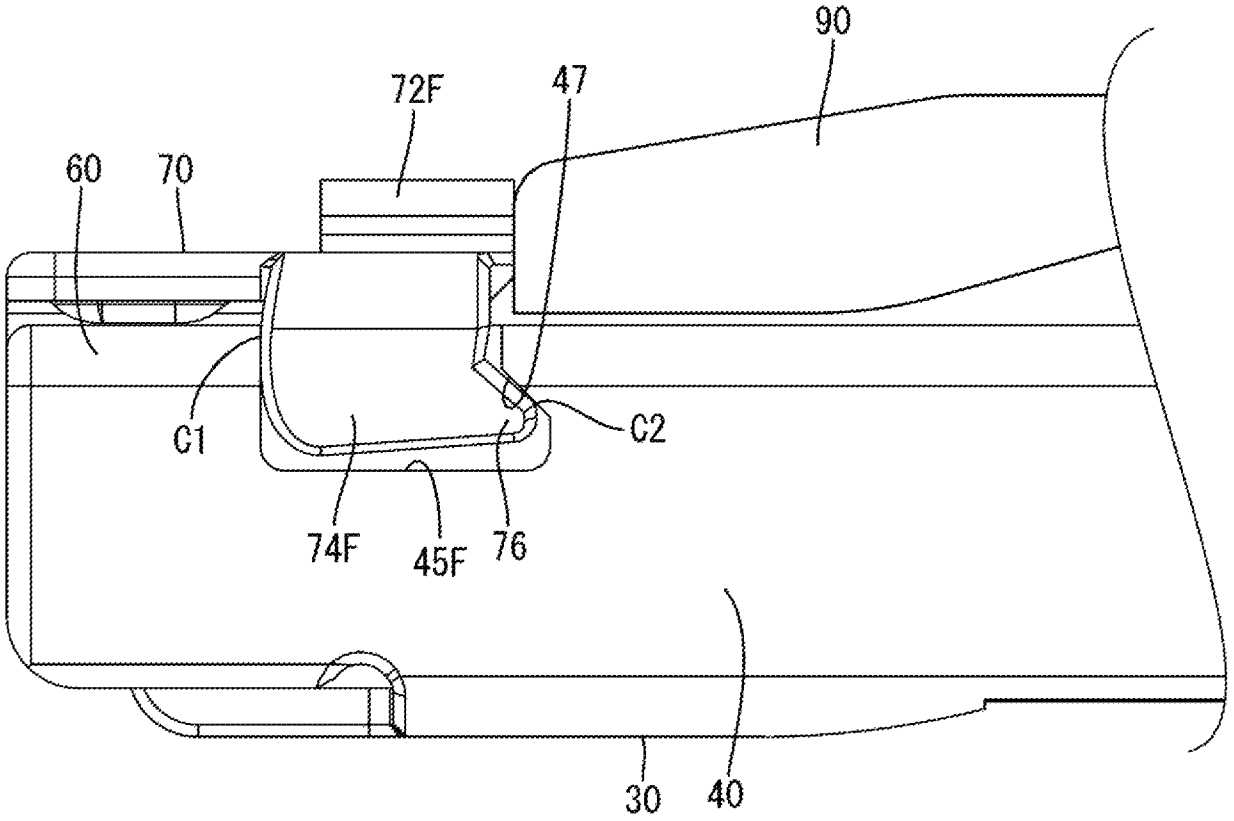
FIG. 9 is a side view showing a state where a restricted portion is locked to a restricting portion from below.

FIG. 9 shows a state where the wire is pulled strongly rearward to deform the front holding piece 74F. If the wire is pulled, the terminal 10 connected to the wire is pulled rearward, the front locking protrusion 72F is pushed forward by the locking lance 90 and a force acts on the outer wall 70 from behind.

If a force acts on the outer wall 70 from behind, the front outer wall 70 normally is going to be turned up along a bending line L1 (see FIG. 5) perpendicular to the force acting from behind and the front holding piece 74F is going to be displaced up while being displaced forward together with the front outer wall 70. At this time, as shown in FIG. 9, the front edge of the front holding piece 74F contact the front edge of the front holding recess 45F, thereby restricting a forward displacement of the front holding piece 74F. Further, if the front holding piece 74F is pushed forward, the front outer wall 70 is going to displace up with a contact part C1 of the front edge of the front holding piece 74 and the front holding recess 45F as a center. The restricted portion 76 then contacts the restricting portion 47 from below. Thus, the restricted portion 76 and the restricting portion 47 lock together at this contact part C2. Therefore, the front holding piece 74F will not displace up and the outer wall 70 will not turn-up.

A force acting from behind also might cause the outer wall 70 to turn up along a bending line L2 (see FIG. 5) extending obliquely to the force. In this case, the front holding piece 74F is displaced laterally (in a direction of an arrow D of FIG. 8) at the same time as the front holding piece 74F is displaced forward together with the outer wall 70. However, the projecting end part of the front holding piece 74F is disposed inside the box 20 in advance. Thus, even if the front holding piece 74F is displaced laterally by the plate thickness, the restricted portion 76 remains at a position locked to the restricting portion 47. Thus, as shown in FIG. 9, the restricted portion 76 is locked to the restricting portion 47 from below at the corner C2 to suppress an upward displacement of the front holding piece 74F and to prevent the outer wall 70 from turning up.

As described above, the front holding piece 74F remains inside the front holding recess 45F even if the front holding piece 74F is displaced laterally by the plate thickness. Thus, a locked state of the front holding piece 74F and the front holding recess 45F is maintained.

The base end part of the front holding piece 74F may be bent inward of the box 20 so that the projecting end part of the front holding piece 74F is located inside the box 20, the restricted portion 76 may project rearward on the rear edge of the front holding piece 74F, and the restricting portion 47 to which the restricted portion 76 is lockable from below may be provided by recessing the rear edge of the front holding recess 45F rearwardly.

A force that acts on the outer wall 70 from behind normally could cause the outer wall 70 to turn up along the bending line L1 perpendicular to the force, and the front holding piece 74F normally would displace up while displacing forward with the outer wall 70. However, the restricted portion 76 is locked to the restricting portion 47 from below in this embodiment. Thus, the front holding piece 74F cannot displace up and the outer wall 70 cannot turn up.

A force acting from behind also could cause the outer wall 70 to turn up along the bending line L2 extending oblique to the force. However, the front holding piece 74F is displaced laterally and simultaneously is displaced forward together with the outer wall 70. However, even if the front holding piece 74F is displaced laterally by the plate thickness, the restricted portion 76 of the first embodiment remains at the position locked to the restricting portion 47 from below. Thus, the front holding piece 74F cannot displace up and the outer wall 70 cannot turn up.

The projecting end of the front holding piece 74F may have the lower surface 74F1, the inner surface 74F2 disposed inward of the lower surface 71 and the outer surface 74F3 disposed outward of the lower end surface 74F1. The corner 74F4 between the lower end surface 74F1 and the inner side surface 74F2 may be located inside the box 20 beyond the front holding recess 45F, and the outer side surface 74F3 may be located inside the front holding recess 45F.

A projection of the front holding piece 74F into the box 20 must avoid interference with the male terminal fit into the box 20. Accordingly, the outer surface 74F3 of the front holding piece 74F is located inside the front holding recess 45F in the first embodiment. Thus, the projecting dimension of the front holding piece 74F into the box 20 can be suppressed to a minimum level. Further, the corner 74F4 between the lower surface 74F1 and the inner side surface 74F2 of the front holding piece 74F is located inside the box 20 beyond the front holding recess 45F, but even if the front holding piece 74F is displaced laterally by the plate thickness, the projecting end of the front holding piece 74F remain inside the front holding recess 45F.

The front holding recess 45F may have the facing surface 45F1 facing the lower surface 74F1 of the front holding piece 74F and the distance from the corner 43 between the facing surface 45F1 and the outer surface 42 of the first side wall 40 to the corner 74F4 of the front holding piece 74F may be equal to or longer than the plate thickness of the front holding piece 74F. According to this configuration, even if the front holding piece 74F is displaced laterally by the plate thickness, the corner 74F4 of the front holding piece 74F remains inside the front holding recess 45F.

Figure 10:
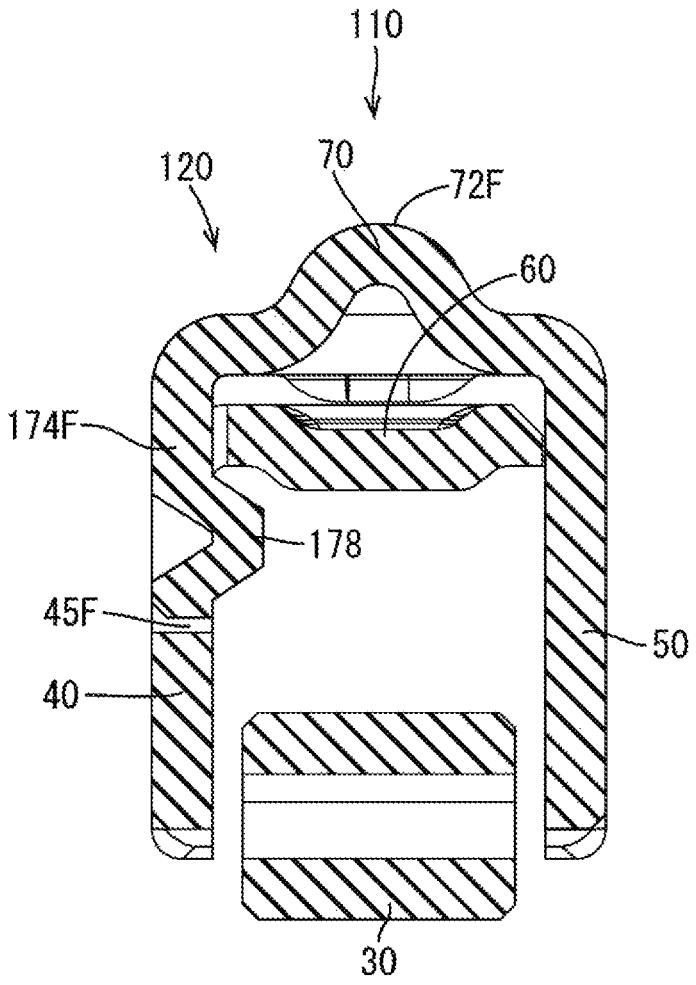
FIG. 10 is a section similar to FIG. 7 but showing of a terminal in a second embodiment.

A second embodiment is described with reference to FIGS. 10 to 12. A terminal 110 of the second embodiment is obtained by changing a part of the configuration of the terminal 10 of the first embodiment, and components common to the first embodiment are denoted by the same reference signs and not described.

Figure 11:
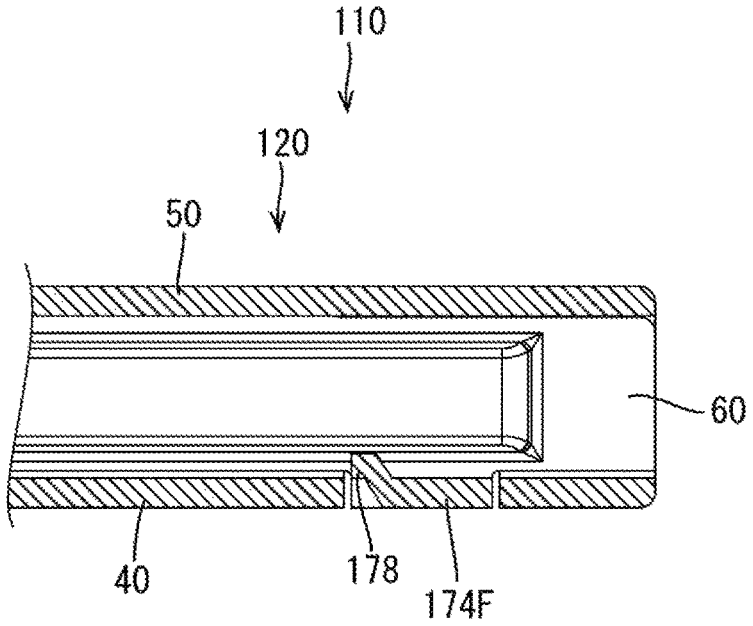
FIG. 11 is a section similar to FIB. 8 but showing the terminal of the second embodiment.
Figure 12:
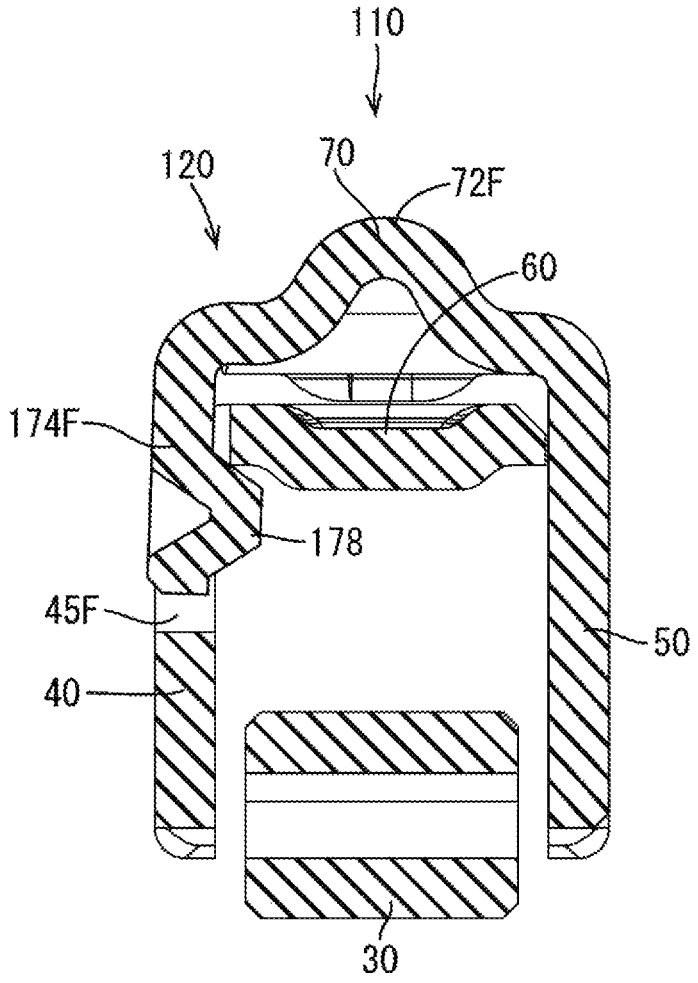
FIG. 12 is a section showing a state where a restricted portion is locked to a restricting portion from below.

A box 120 of the terminal 110 of the second embodiment has a front holding piece 174F parallel to the first side wall 40 instead of the front holding piece 74F of the first embodiment, as shown in FIG. 11. A projection 178 is provided on a rear part of the front holding piece 174F and projects inward of the box 120 by at least a plate thickness. The projection 178 projects inward from an inner side surface 174F2 of the front holding piece 174F and is located below a ceiling wall 60. Thus, as shown in FIG. 12, the projection 178 is locked to the ceiling wall 60 from below and prevents the outer wall 70 from turning up.

The invention is not limited to the above described and illustrated first and second embodiments. For example, the following modes also are included.

Although the base end part of the front holding piece 74F is bent inward in the first embodiment, a bent part may not be the base end part.

Although the restricted portion 76 and the restricting portion 47 are provided in the first embodiment, the restricted portion 76 and the restricting portion 47 may not be provided.

Although the outer side surface 74F3 of the projecting end part of the front holding piece 74F is disposed inside the front holding recess 45F in the first embodiment, the outer side surface 74F3 may be disposed inside the box 20.

Although the distance from the corner part 43 between the facing surface 45F1 and the outer side surface 42 of the one side wall 40 to the corner part 74F4 of the front holding piece 74F is equal to or longer than the plate thickness of the front holding piece 74F in the first embodiment, this distance may be equal to or shorter than the plate thickness.

Although the projection 178 is provided on the rear end part of the front holding piece 174F in the second embodiment, a projection may be provided on a front end part of the front holding piece 174F.

LIST OF REFERENCE SIGNS

10 . . . terminal
20 . . . box
30 . . . bottom wall
31 . . . side edge
40 . . . first side wall
41 . . . upper edge
42 . . . outer side surface
43 . . . corner part
45F . . . front holding recess
45F1 . . . facing surface
47 . . . restricting portion
50 . . . second side wall
51 . . . upper edge
60 . . . ceiling wall
70 . . . outer wall
73F . . . extending end part
74F . . . front holding piece
74F1 . . . lower end surface
74F2 . . . inner side surface
74F3 . . . outer side surface
74F4 . . . corner part
76 . . . restricted portion
110 . . . terminal
120 . . . box
174F . . . front holding piece
174F2 . . . inner side surface
178 . . . projection

What is claimed is:

1. An electrical terminal formed of a plate material and includes a rectangular tubular box that is open in a front-rear direction, wherein:

the box includes a bottom wall, first and second side walls rising from both sides of the bottom wall, a ceiling wall extending from an upper end of the first side wall toward the second side wall and an outer wall extending from an upper end of the second side wall toward the first side wall along an upper surface of the ceiling wall;

a holding piece projecting on an extending end part of the outer wall and a holding recess is provided on an upper end part of the first side wall, the holding piece being accommodated inside the holding recess; and a projecting end part of the holding piece has a lower surface, an inner surface disposed inward of the lower surface and an outer surface disposed outward of the lower surface, a corner between the lower surface and the inner surface is located inside the box beyond the holding recess, and the outer surface is located inside the holding recess.

2. The electrical terminal of claim 1, wherein a base end part of the holding piece is bent inwardly of the box so that projecting end part of the holding piece is located inside the box, a restricted portion projects rearward on a rear edge of the holding piece and a restricting portion is provided by recessing a rear edge of the holding recess rearwardly, the restricted portion being locked to the restricting portion from below.

3. The electrical terminal of claim 1, wherein the holding recess has a facing surface facing the lower surface of the holding piece, and a distance from a corner between the facing surface and an outer side surface of the first side wall to a corner of the holding piece is equal to or longer than a plate thickness of the holding piece.

4. An electrical terminal formed of a plate material and includes a rectangular tubular box that is open in a front-rear direction, wherein:

the box includes a bottom wall, first and second side walls rising from both sides of the bottom wall, a ceiling wall extending from an upper end of the first side wall toward the second side wall and an outer wall extending from an upper end of the second side wall toward the first side wall along an upper surface of the ceiling wall;

a holding piece projecting on an extending end part of the outer wall and a holding recess is provided on an upper end part of the first side wall, the holding piece being accommodated inside the holding recess; and a projection provided on an inner side surface of the holding piece and projecting inward of the box by at least a plate thickness, the projection being lockable to the ceiling from below.

* * * * *